United States Patent [19]

Darlington et al.

[11] 4,293,394

[45] Oct. 6, 1981

[54] ELECTROLYTICALLY PRODUCING CHLORINE USING A SOLID POLYMER ELECTROLYTE-CATHODE UNIT

[75] Inventors: William B. Darlington, Portland; Donald W. DuBois; Preston S. White, both of Corpus Christi, all of Tex.

[73] Assignee: PPG Industries, Inc., Pittsburgh, Pa.

[21] Appl. No.: 135,960

[22] Filed: Mar. 31, 1980

[51] Int. Cl.[3] ..... C25B 1/16; C25B 1/26; C25B 1/46; C25B 13/04

[52] U.S. Cl. ..... 204/98; 204/128; 204/266; 204/296

[58] Field of Search ..... 204/98, 128, 129, 266, 204/295

[56] References Cited

U.S. PATENT DOCUMENTS 4,191,618 3/1980 Coker et al. ..... 204/128

*Primary Examiner*—Howard S. Williams

*Attorney, Agent, or Firm*—Richard M. Goldman

[57] ABSTRACT

Disclosed is a solid polymer electrolyte electrolytic cell where the cathodic reaction takes place at a three phase catholyte-cathode catalyst-permionic membrane interface. The structure to carry this out may have electroconductive but electrolytically inactive portions of the cathode bonded to and embedded in the solid polymer electrolyte, and electrolytically active portions of the cathode extending outward from the permionic membrane into the catholyte. Alternatively, the cathode may compressively bear on a gel of permionic membrane material. Preferably the electrolytically active portions of the cathode extend out to about 1000 Angstroms into the catholyte, whereby to maintain the electrolysis within about 1000 Angstroms of the permionic membrane. The formation of hydroxyl ion within the permionic membrane is substantially avoided.

16 Claims, 6 Drawing Figures

ELECTROLYTICALLY PRODUCING CHLORINE USING A SOLID POLYMER ELECTROLYTE-CATHODE UNIT

Solid polymer electrolyte chlor-alkali cells have an electrode bearing cation selective permionic membrane separating the anolyte liquor from the catholyte liquor. For example either the anodic electrocatalyst or the cathodic electrocatalyst, or both may compressively bear upon the permionic membrane, that is, be in contact with, but not physically or chemically bonded to the surfaces of the permionic membrane. Alternatively, either the anodic electrocatalyst or the cathodic electrocatalyst or both may be embedded in or physically or chemically bonded to the permionic membrane.

The commonly assigned co-pending U.S. Application Ser. No. 76,898, filed Sept. 19, 1979 for SOLID POLYMER ELECTROLYTE CHLOR ALKALI PROCESS AND ELECTROLYTIC CELL by William B. Darlington and Donald W. DuBois describes a solid polymer electrolyte chlor-alkali cell where either the anode or the cathode or both compressively bear upon, but are neither embedded in nor bonded to the permionic membrane.

The commonly assigned co-pending U.S. Application Ser. No. 120,217, filed Feb. 11, 1980, for SOLID POLYMER ELECTROLYTE CHLOR ALKALI PROCESS AND ELECTROLYTIC CELL, of William B. Darlington and Donald W. DuBois, a continuation-in-part of U.S. Application Ser. No. 76,898, describes a solid polymer electrolyte electrolytic cell where there is no electrolyte gap, that is, no liquid gap between the anodic electrocatalyst which compressively bears upon the anodic surface of the permionic membrane and the membrane, while the cathodic electrocatalyst is bonded to and embedded in the cathodic surface of the permionic membrane. It is there disclosed that the high current density and low voltage of the solid polymer electrolyte cell are obtained while simple mechanical current collectors and electrode supports are retained on the anolyte side of the cell.

A compressive cathode solid polymer electrolyte, i.e., a solid polymer electrolyte where the cathode bears compressively upon the permionic membrane but is neither bonded to nor embedded in the membrane is characterized by a higher cathodic current efficiency and a lower anolyte $H_2$ content than a conventional solid polymer electrolyte. A conventional solid polymer electrolyte, i.e., a solid polymer electrolyte where the cathodic electrocatalyst is bonded to and embedded in the permionic membrane, is characterized by a lower voltage than a compressive cathode solid polymer electrolyte. A particularly desirable solid polymer electrolyte would be one combining the cathode current efficiency and anolyte $H_2$ attributes of a compressive cathode solid polymer electrolyte with the voltage characteristics of a conventional solid polymer electrolyte.

It has now been found that cathode current efficiency, anolyte $H_2$ content, and, to a lesser extent, anolyte oxygen and chlorate contents, are inter-related. It is believed that diminished cathode current efficiency and increased anolyte $H_2$ of the conventional solid polymer electrolyte over the compressive cathode solid polymer electrolyte are the result of hydrogen evolution, $$H_2O+e^- \rightarrow OH^- + H_1O,$$

occurring within the permionic membrane. This is believed to be the result of the migration of the hydroxyl ion so formed within the membrane not being subject to exclusion by the permionic membrane, and therefore being drawn toward the anode.

It is believed that the higher voltage of the compressive solid polymer electrolyte over the conventional solid polymer electrolyte is caused by electrolytic conduction, within the catholyte liquor, even a thin film thereof, of sodium ion.

It has now been found that the advantages of a conventional, bonded solid polymer electrolyte, e.g., low voltage, as well as the advantages of a compressive solid polymer electrolyte, e.g., high cathode current efficiency and low anolyte $H_2$ content, may be obtained when the cathodic reaction is carried out adjacent the permionic membrane, but neither remote from nor within the permionic membrane.

It has also been found that the advantages of a conventional, bonded solid polymer electrolyte, and the advantages of a compressive cathode solid polymer electrolyte may be obtained where cathode catalyst is excluded from within the membrane, while electrolyte films between the cathode and membrane are also avoided.

It has now been found that one particularly desirable solid polymer electrolyte unit may be provided having cathode catalyst particles bonded to and embedded in the permionic membrane, with each particle having a substantially non-catalytic region, i.e., a high overvoltage region, embedded in the permionic membrane, and a low overvoltage region extending outwardly from the permionic membrane. By this expedient, a conductive, but substantially non-catalytic region provides conductivity and adhesion, while a catalytic region extends outwardly from the membrane surface to approximately one to several molecular layers above the membrane surface. In this way the evolution of hydroxyl ion within the permionic membrane is substantially eliminated.

It has now been found that another particularly desirable solid polymer electrolyte unit may be provided having the cathode electrocatalyst bonded to but not embedded in the permionic membrane. By this expedient the active cathode catalyst area is substantially entirely within the catholyte, and extends from the membrane surface to approximately one to several molecular monolayers above the membrane's surface such that the evolution of hydroxyl ion within the permionic membrane is substantially eliminated.

It has now further been found that a particularly desirable solid polymer electrolyte unit may be provided having the cathode elements compressively bearing on a porous gel of permionic membrane material. By this expedient, the cathode is in uniform contact with permionic membrane, that is, contact sufficiently uniform to substantially avoid electrolytic conduction from the permionic membrane through catholyte liquor, to the cathode, thereby providing a voltage lower than that of a compressive solid polymer electrolyte. Moreover, by this expedient penetration and performation of the permionic membrane are avoided while numerous active sites, i.e., three phase catholyte liquor-cathode electrocatalyst-permionic membrane interface are provided, thereby avoiding electrolysis within the permionic membrane while providing sites for electrolysis at the three phase catholyte liquor-cathode-permionic membrane interface.

THE FIGURES

DETAILED DESCRIPTION

Figure 1:
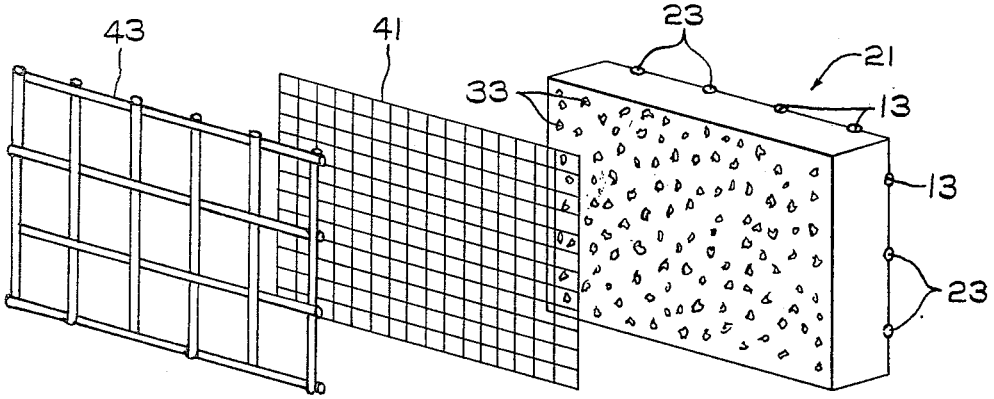
FIG. 1 is an isometric view of an element of a solid polymer electrolyte having cathode particles embedded in the permionic membrane from the cathodic side.

The chlor-alkali solid polymer electrolyte shown in the Figures has a solid polymer electrolyte unit 1 separating the anolyte liquor 20 from the catholyte liquor 30. The solid polymer electrolyte unit 1 has a permionic membrane 11 with an anodic unit 21 on the anolyte surface thereof, and a cathodic unit 31 on the catholyte surface thereof. The anodic unit includes anode mesh 23, which bears upon the permionic membrane 11, deforming the anode surface of the permionic membrane 11, as shown, for example by anode element deformate 13.

Figure 2:
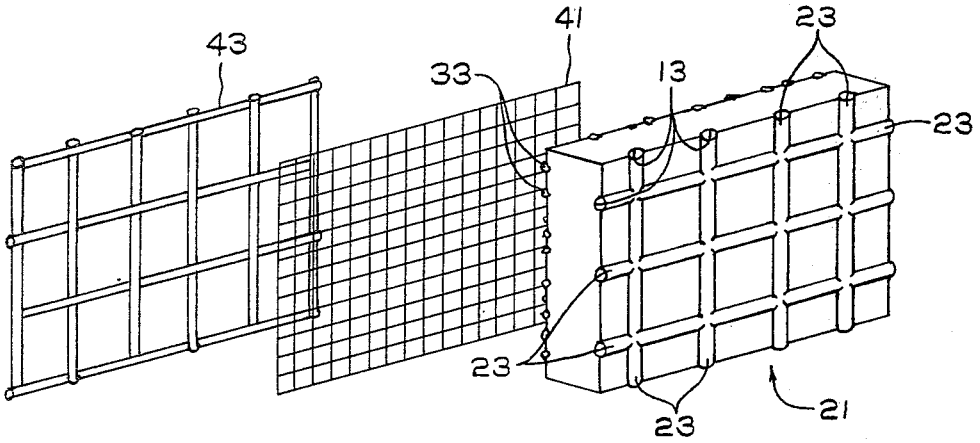
FIG. 2 is an isometric view of an element of the solid polymer electrolyte of FIG. 1 having cathode particles embedded in the permionic membrane from the anodic side.
Figure 3:
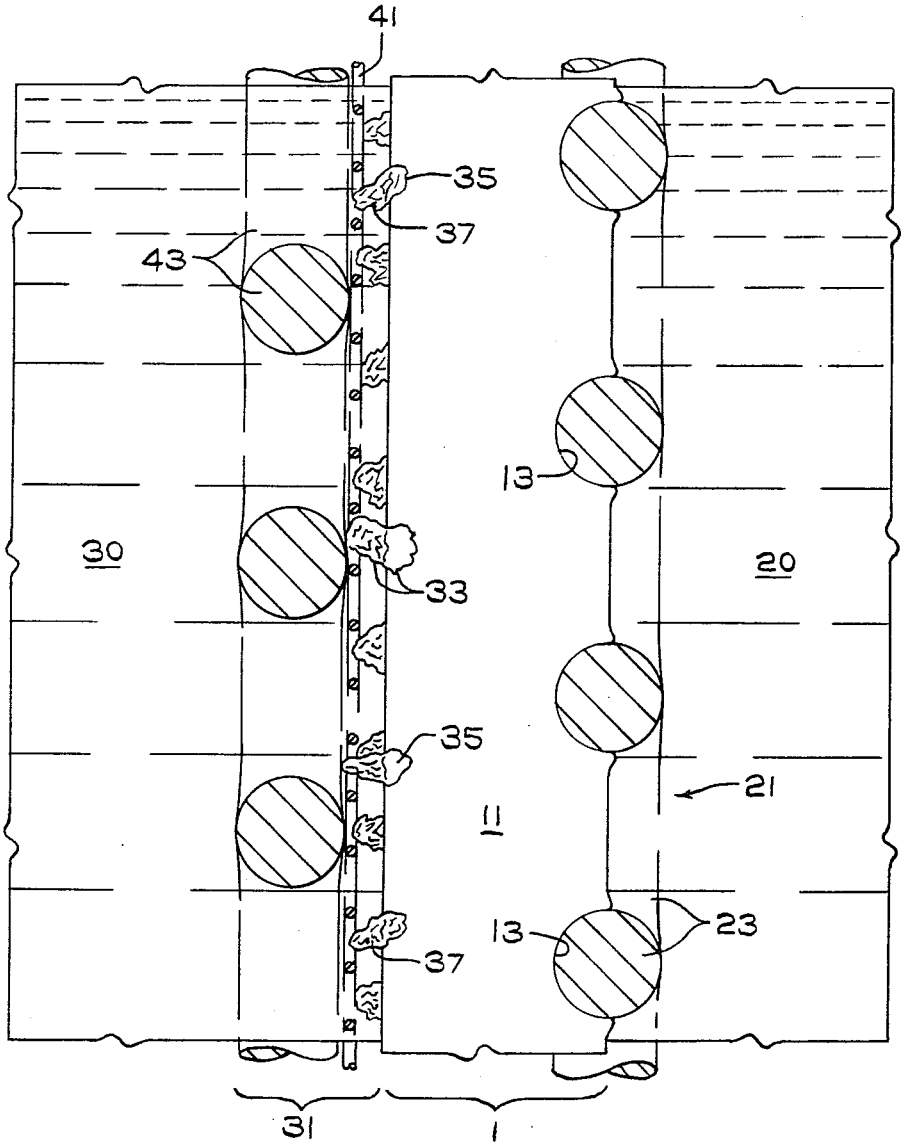
FIG. 3 is a cutaway view of the solid polymer electrolyte of FIGS. 1 and 2 having cathode particles embedded in the permionic membrane.

In the exemplification shown in FIGS. 1, 2 and 3, the cathode unit 31 has cathode particles 33 bonded to the permionic membrane 11. Bearing upon the cathode particles 33 are a fine mesh conductor 41 and a coarse mesh conductor 43.

Figure 4:
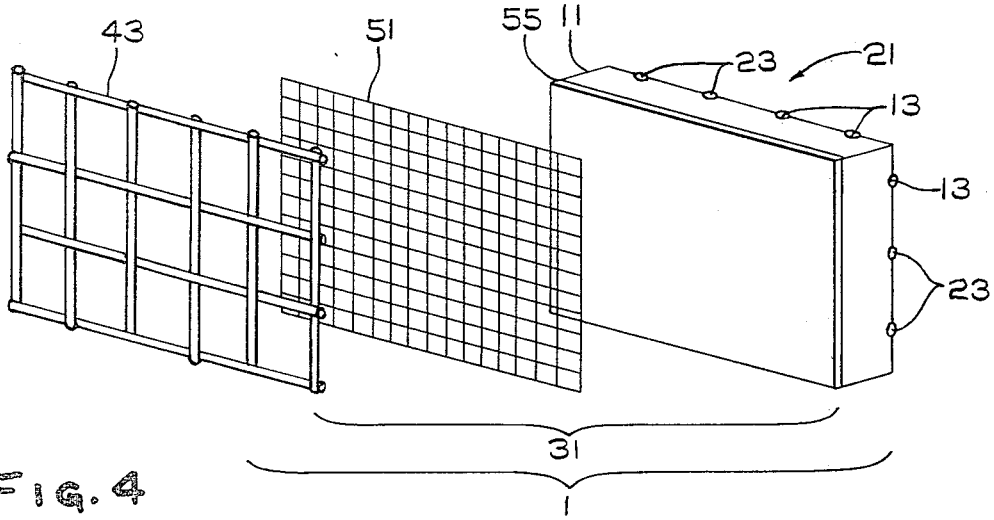
FIG. 4 is an isometric view of an element of a solid polymer electrolyte having a cathode screen compressively bearing on a permionic membrane material gel coated permionic membrane.
Figure 5:
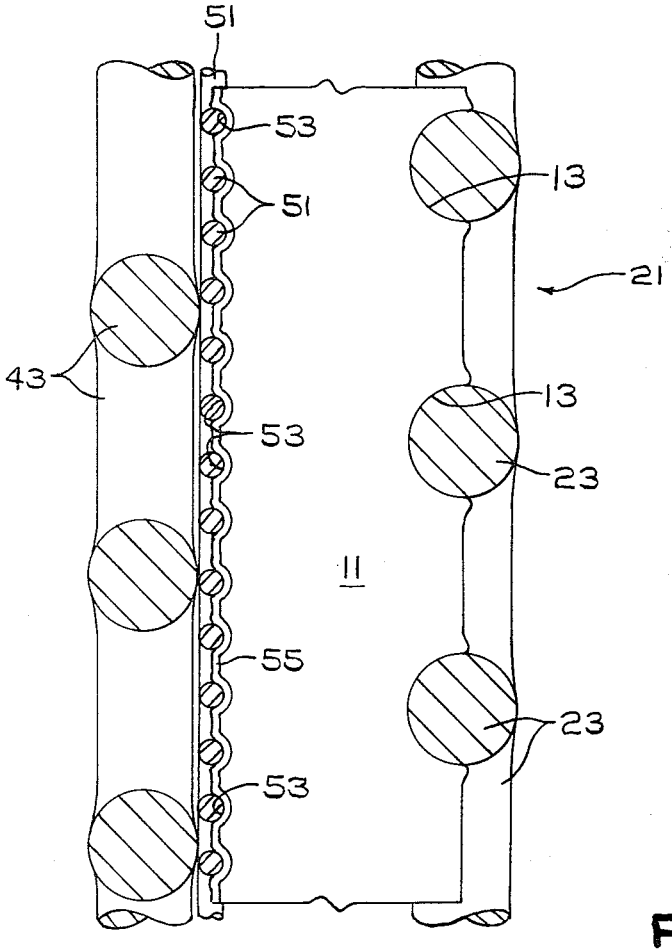
FIG. 5 is a cutaway view of the solid polymer electrolyte of FIG. 4 having a cathode screen compressively bearing on a permionic membrane material gel coated permionic membrane.
Figure 6:
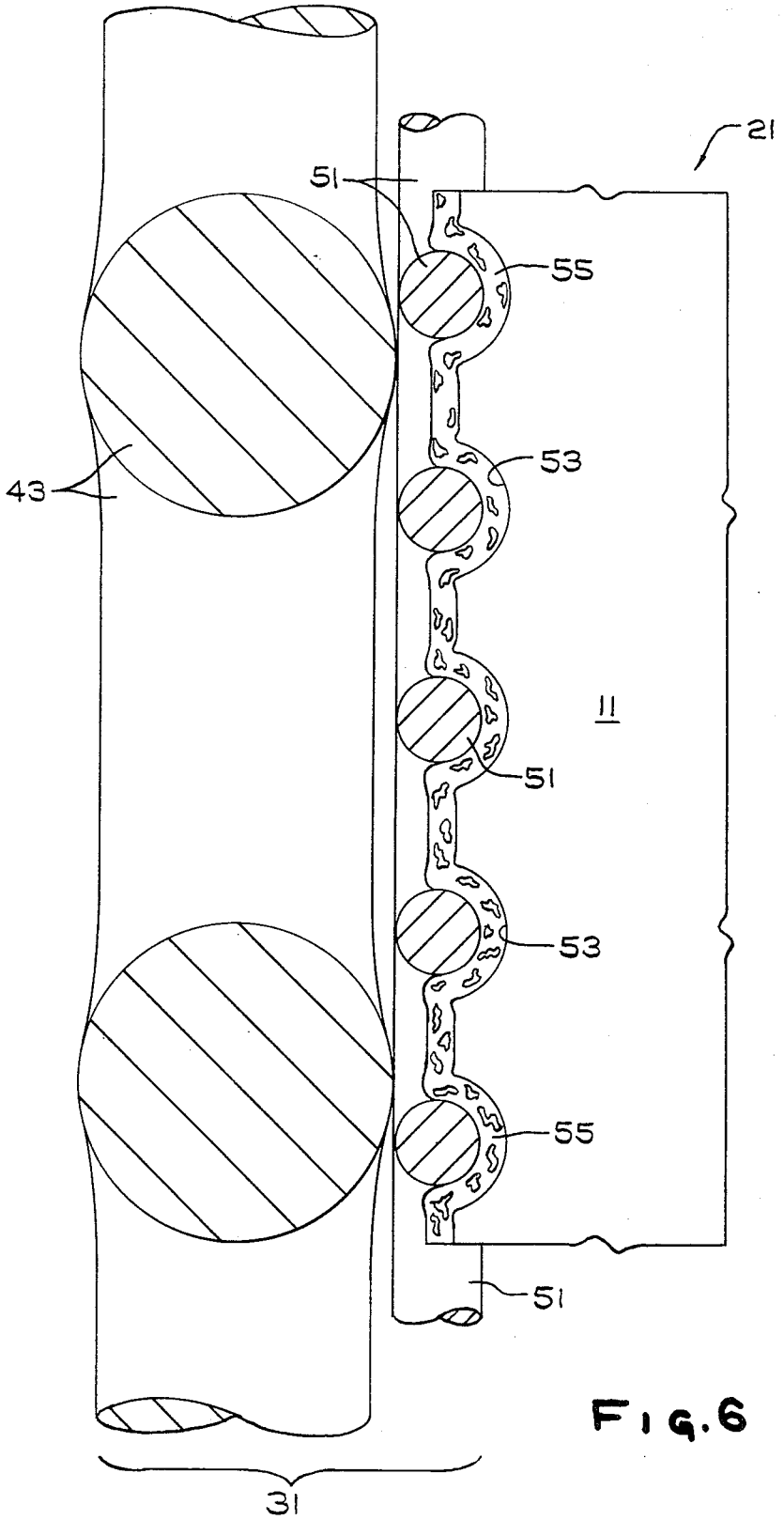
FIG. 6 is a detailed view of a section of the solid polymer electrolyte of FIGS. 4 and 5 having a cathode screen compressively bearing on a permionic membrane material gel coated permionic membrane.

In the exemplification shown in FIGS. 4, 5, and 6, the cathode unit 31 has a cathode screen 51 compressively bearing on the permionic membrane 11, with the individual elements thereof deforming the permionic membrane 11 and forming troughs 53 therein. The troughs 53 and the cathodic surface of the permionic membrane 11 are coated with a film of a porous gel 55 of permionic membrane material.

It has now been found that the cathodic energy efficiency, i.e. the product of the cell voltage, the current density, and the cathode current efficiency, is enhanced, at constant anode configuration, anode chemistry, and membrane chemistry, the anolyte $Cl_2$ content is reduced, and the voltage is reduced, when the cathodic reaction is carried out adjacent to, and neither remote from nor within the permionic membrane 11. For example, when the cathode catalyst 33 is bonded to the permionic membrane 11 while the active cathode catalyst area 37 is substantially entirely in a volume of catholyte liquor 30 extending from the surface of the membrane 11 to one to several molecular monolayers distant from the membrane 11, for example to about 1000 Angstroms from the membrane 11, the reaction is carried out adjacent to the permionic membrane 11, and formation of hydroxyl ion and $H_2$ both within the permionic membrane 11 and within the catholyte 30 is avoided.

In the exemplifications described herein, penetration of the permionic membrane 11 by catalyst particles 33 or by cathode catalyst carrier 51 is to be avoided. This is because cathode catalyst 33, 51 surrounded by the permionic membrane 11 and remote from catholyte liquor 30 is a preferential site for hydroxyl ion and hydrogen evolution, which hydroxyl ion is not subject to the exclusionary effect or ion selectivity of the permionic membrane 11 and is electrostatically drawn toward the anode 21.

Turning with particularity to FIG. 3, it is seen that the individual cathode particles 33, when embedded in the permionic membrane 11, are characterized by two distinct zones, and a non-catalytic zone 35 embedded within the permionic membrane 11 and a porous, catalytic zone 37 extending outwardly from the permionic membrane 11 into the catholyte 30, and in contact with the fine conductor 41.

In one preferred exemplification, a major portion of the cathode electrocatalyst active surface 37 extends outwardly from the permionic membrane 11, but within 1000 Angstroms of the surface of the permionic membrane 11 whereby to avoid having cathodic electrocatalyst extending more than 1000 Angstroms from the surface of the permionic membrane.

In this way the cathode reaction, $$H_2O+e^- \rightarrow OH^- + HO_1,$$

is concentrated in a several molecule thick layer adjacent the membrane, 11 at a cathodic electrocatalyst 31-permionic membrane 11-catholyte liquor 30 three phase interface.

According to one particularly desired exemplification, the cathode means 31 are oriented particles 33 having a higher hydrogen over-voltage, non-catalytic area 35 bonded to and embedded in the permionic membrane 11 and a lower hydrogen overvoltage, catalytic area 37 extending outwardly from the permionic membrane 11 into a layer several molecules thick of catholyte liquor 30. The difference in hydrogen overvoltage between the non-catalytic region 35 and the catalytic region 37 need be only on the order of several millivolts, i.e., up to about 50 millivolts, although greater differences, e.g., of 100 millivolts or more are preferred.

The lower hydrogen overvoltage catalytic area 37 extends upwardly and outwardly from the surface of the permionic membrane 11 into the catholyte liquor 30 while the higher hydrogen overvoltage, non-catalytic area 35 is embedded in the permionic membrane 11. Preferably, a major portion of the non-catalytic area 35 of the particle area 33 is embedded in the permionic membrane 11, and a major portion, preferably substantially all of the catalytic portion 37 of the particle 33, extends outwardly from the permionic membrane 11. It is particularly desirable to have substantially none of the catalytic portion 37 within the permionic membrane whereby to avoid hydroxyl ion generated within the permionic membrane.

Where the particle 33 extends more than 1000 Angstrom units from the permionic membrane 11 there may also be a second, high overvoltage, non-catalytic portion, not shown, on that part of the cathode particle 33 more than 1000 Angstroms from the permionic membrane surface, whereby to avoid hydroxyl evolution in the catholyte liquor 30 more than 1000 Angstroms from the surface of the permionic membrane. Thus, as herein contemplated, a non-catalytic portion 35 of the cathode particle 33 is bonded to and embedded in the permionic membrane 11, a catalytic portion 37 extends outwardly from the permionic membrane 11 to about 1000 Angstroms from the surface of the permionic membrane 11 and a non-catalytic high overvoltage portion, not shown, of the catalyst particle 33 extends outward from more than 1000 Angstroms from the surface of the permionic membrane 11 whereby to substantially avoid hydrogen evolution in the body of the catholyte liquor 30.

The lower hydrogen overvoltage, catalytic region 37, of the cathode catalyst particle 31 may be platinum black, palladium black, porous nickel, or other low hydrogen overvoltage, and frequently high surface material. The higher hydrogen overvoltage, non-catalytic region 35 of the cathode particle 33 may be iron, steel, cobalt, nickel, chromium, copper, palladium, iridium, osmium, rhodium, rhuthenium, or graphite, and is preferably substantially non-porous or impervious whereby to have a significantly higher hydrogen overvoltage than the catalytic portion 37 of the cathode particle 33.

According to one embodiment, the portion 35 of the cathode particle 33 embedded in the permionic membrane 11 may be platinum or graphite, and the catalytic portion 37 extending outwardly therefrom may be platinum black. Alternatively, the portion 35 of the cathode particle 33 embedded in the permionic membrane may be paladium or graphite and the catalytic portion 37 extending outwardly from the permionic membrane 11 may be paladium black.

According to a still further embodiment of this exemplification of the invention, nickel particles 33 may be embedded in the permionic membrane 11, the individual particles 33 having a porous nickel surface 37 exposed to the catholyte and an imporous nickel surface 35 embedded within the permionic membrane. A nickel catalyst, as herein contemplated, may be prepared by depositing nickel and zinc on a portion of a nickel particle and thereafter leaching out the zinc, as will be described more fully hereinbelow. Alternatively, an alloy of nickel and aluminum may be deposited on one hemisphere of a nickel particle and the aluminum leached out.

According to a still further exemplification of this invention, cathode particles may be oriented during deposition, for example by magnetic susceptibility where the particles 33 are deposited in the permionic membrane 11 under the influence of a magnetic field.

According to an alternative exemplification, shown in FIGS. 4, 5, and 6, the cathode electrocatalyst may be present as a film, surface, layer, or deposit on a cathode carrier 51. The cathode carrier 51 compressively bears upon the cathodic surface of the permionic membrane 11, partially deforming the surface thereof, whereby to form troughs, valleys, or the like 53. The troughs and valleys 53 contain a gel or matrix 55 of permionic membrane material.

In this way the cathode reaction $$H_2O+e^-\rightarrow OH^-+H_1^O$$

takes place in a several molecule thick region adjacent the permionic membrane 11, i.e., at a cathodic electrocatalyst 51-electrolyte 30-permionic membrane 11 three phase interface within the permionic membrane material gel 55.

As herein contemplated, the cathode means 31 comprise cathode electrocatalyst, as a film, surface, layer, or deposit on the cathode catalyst carrier 51. The cathodic electrocatalyst may be any low hydrogen overvoltage material resistant to concentrated aqueous alkali metal hydroxide. Suitable materials include precious metals, as platinum, iridium, osmium, palladium, rhodium, and ruthenium, oxides of precious metals, as ruthenium dioxide, oxycompounds of precious metals, as perovskites, pyrochlores, delafossites and the like, reduced oxides of precious metals, as platinum black and palladium black, transition metals as iron, cobalt, nickel, manganese, chromium, vanadium, molybdenum, columbium, tungsten, and rhenium, high surface area transition metals as exemplified by porous nickel, and oxycompounds of transition metals, as spinels, perovskites, bronzes, tungsten bronzes, pyrochlores, delafossites, and the like.

The cathode catalyst carrier 51 may be any material resistant to concentrated aqueous alkali metal hydroxide. Preferably the cathode catalyst carrier 51 is fabricated of a material that is extrudable, ductile, or workable whereby to form the fine mesh herein contemplated.

The permionic membrane material gel 55 is a porous gel or matrix resulting from coating the permionic membrane 11 with a solution, slurry, dispersion or other liquid composition of permionic membrane material, e.g., low molecular weight polymers thereof, and partially evaporating the liquid, solvent, surfactant, or the like, whereby to leave a porous open matrix, gel, or foam 55 on the surface of the permionic membrane. The porous open matrix, gel, or foam has a sufficient porosity to hold electrolyte, but contains sufficient solid material to provide contact with the cathode catalyst carrier 51.

The permionic membrane material 55 is a fluorocarbon resin ion exchange material as will be more fully described hereinbelow. It may be the permionic membrane material as the solid polymer electrolyte permionic membrane 11, i.e., they both may be carboxylic acid materials or they both may be sulfonic acid materials. Alternatively, they may be different materials, as one may be sulfonic acid and the other may be carboxylic acid.

The solid polymer electrolyte of this invention is used in carrying out electrolysis, for example to evolve chlorine at the anode and hydroxyl ion at the cathode while avoiding formation of hydroxyl ion and hydrogen inside the permionic membrane. That is, substantially all of the hydroxyl ion is formed in the catholyte liquor 30 adjacent the permionic membrane 11 and substantially none is formed inside the permionic membrane 11. Preferably, substantially all of the hydroxyl evolution is within 1000 Angstroms of the permionic membrane, for example within a layer or monolayer of molecules on the surface of the permionic membrane 11, e.g., at the three phase interface of the permionic membrane 11, the cathode catalyst 33 and the catholyte liquor 30 or within the permionic material gel 55 between the permionic membrane 11 and the cathode catalyst 57. This avoids hydroxyl ion within the membrane 11 and transportation through the permionic membrane 11 to the anolyte liquor 20.

The solid polymer electrolyte 1 herein contemplated may be prepared by providing point contact of electrocatalyst particles 33 where the entire electrocatalyst particle 33 is the low hydrogen overvoltage, catalytic portion 37 thereof.

Point contact may be provided by first softening the permionic membrane 11 with a solvent, that is a swelling solvent, such as an ether, an alcohol, a diol, a glycol, a ketone, a diketone or the like. Alternatively, a solution or gel of low molecular weight permionic membrane material may be deposited on the surface of the permionic membrane 11 in a suitable solvent such as N-methyl pyrolidone or ethanol. Alternatively, the permionic membrane 11 may be rendered thermoplastic.

Thereafter, the electrocatalyst particles, whether oriented, and having a noncatalytic portion 35 and a porous catalytic portion 37 or being solely a porous catalytic portion 37 may be deposited on the permionic membrane 11. Where the cathode particles 33 are primarily catalytic, low overvoltage areas 37, the particles 33 are deposited with minimum imposed pressure i.e. from about 1 to about 5 pounds per square inch gauge, whereby to obtain adhesion but to avoid substantial penetration 15 of the permionic membrane 11.

According to a still further exemplification of this invention, nickel may be deposited, as particles, in the permionic membrane 11. This may be done by the method of rendering the membrane thermoplastic, as described in the commonly-assigned copending application of Preston S. White for SOLID POLYMER ELECTROLYTE AND METHOD OF PREPARING SAME, Ser. No. 105,055, filed Dec. 19, 1979, or by softening with a solvent as described above or by the use of a solution or gel of permionic membrane material. Thereafter, an alloy of nickel and zinc may be deposited onto the deposited nickel particles, for example by maintaining the deposited nickel particles 33 and permionic membrane 11 in acid solution, so as to retain ease of physical handling, while electrodepositing nickel and zinc thereon. This may be accomplished by interposing the membrane 11 between a cathode current collector bearing on the anodic surface thereof and an electro plating anode. Thereafter nickel and zinc are electrodeposited onto the particles 33 embedded in the membrane. Subsequently, the permionic membrane may be removed from the electrodeposition cell and installed in an electrolytic cell where the action of the alkaline catholyte liquor 30 will leach the zinc from the particles 33, leaving the deposited nickel zinc alloy as a porous surface 37 exposed to the catholyte liquor 30 while providing a substantially non-porous nickel region 35 within the permionic membrane 11.

According to a still further method of this invention, graphite particles are deposited in a permionic membrane 11, softened as described above, and thereafter catalyst material may be deposited thereon, for example chloroplatinic acid or the like.

The solid polymer electrolyte unit shown in FIGS. 4, 5, and 6 is characterized by a porous matrix gel deposit 55 between the cathode current carrier 51 and the permionic membrane 11. The matrix gel deposit 55 conforms to the cathode current carrier 51, and is in substantially uniform contact therewith, and also conforms to the permionic membrane and is in substantially uniform contact therewith. In this way, ridges, peaks, valleys and other sources of point contact are avoided, as are possible regions of electrolyte film between the cathode current carrier 51 and the permionic membrane 11.

The solid polymer electrolyte unit shown in FIGS. 4, 5, and 6 is prepared by first applying a layer, film, or coating of a liquid composition of permionic membrane material to the cathode facing surface of the permionic membrane 11. Thereafter the liquid medium is partially evaporated, and subsequently the cathode catalyst carrier 51 is laid down on the gel 55, e.g., deforming the permionic membrane, as at deformates 53.

The permionic membrane material used to prepare the gel 55 may have the same functional groups as the solid polymer electrolyte permionic membrane 11. That is, both of them may have carboxylic acid groups or both of them may have sulfonic acid groups. Alternatively, the permionic membrane material used to prepare the gel 55 may have functional groups different from those of solid polymer electrolyte permionic membrane 11, that is one of them may have sulfonic acid groups and the other one may have carboxylic acid groups.

The permionic membrane material used to prepare the gel 55 should have a higher solubility or dispersibility in the solvent used to prepare the liquid composition than does the solid polymer electrolyte permionic membrane 11. For example, it should have a lower weight average degree of polymerization or less cross-linking agent.

When the permionic membrane material is a perfluorocarbon sulfonic acid polymer, it may be solubilized with ethanol. When the permionic membrane material is a perfluorocarbon carboxylic acid polymer, it may be solubilized with N-methyl pyrolidone. The amounts of solvent and polymer should be such as to provide a viscous liquid composition, capable of being applied to the permionic membrane, adhering thereto during heating, and conforming thereto, without being a highly viscous, tacky gum. The liquid composition is then applied to the cathodic surface of the permionic membrane 11 by spraying, brushing, pouring, or the like. Thereafter the coated permionic membrane 11 is heated for a time and to a temperature sufficient to evaporate a portion of the solvent, e.g., from about ten percent to about ninety percent of the solvent, leaving behind a porous, free-standing, self-supporting, gel or foam structure about 1000 Angstroms to about $10^5$ Angstroms thick, and having some resiliency.

Thereafter the cathode catalyst carrier 51 is applied to the cathode facing surface of the permionic membrane 11. Application is carried out, for example, by compression, and, in one exemplification, under conditions where the permionic membrane 11 is thermoplastic.

Either the surface of the cathode catalyst carrier 51 facing the catholyte liquor, or the surface of the cathode catalyst carrier 51 facing and compressively bearing on the permionic membrane 11, or both surfaces of the cathode catalyst carrier 51 are coated with the electrocatalyst. In a preferred embodiment both surfaces of the cathode catalyst carrier 51 are coated with cathode electrocatalyst material. In a particularly preferred embodiment, only the surface of the cathode catalyst carrier 51 compressively bearing upon the permionic membrane 11 is coated with electrocatalyst.

The back, or catholyte facing surface of the cathode catalyst carrier 51 should be open to the electrolyte 30 whereby to allow the evolved hydroxyl ion and hydrogen access to the electrolyte 30, and to avoid the formation of a hydrogen path between the cathode catalyst carrier 51 and the permionic membrane 11, i.e., inside the gel 55.

The anode 21 is shown as mesh 23 bearing upon the permionic membrane 11 and partially deforming the permionic membrane 11 as shown by deformate 13. The anode material may, also, be deposited in, bearing upon and bonded to the permionic membrane 11. However, where the anodic unit 21 is as shown in the figures, the anodic voltage and anode current efficiency are believed to be functions of the pressure of the anodic element 21 bearing upon the permionic membrane 11. Thus, it has been found that the voltage initially decreases with increasing pressure, that is, with increasing compression of the permionic membrane 11 between the anodic mesh 23 and the cathode mesh conductors 41 and 43. Thereafter, the rate of voltage decrease when increasing pressure diminishes and ultimately, a constant voltage is attained which voltage is substantially independent of increasing pressure.

The pressure voltage relationship is a function of the resiliency and elasticity of the cathode current conductors 41 and 43, the cathode catalyst carrier 51, when present, and of the anode substrate 23, as well as the resiliency and elasticity of the permionic membrane 11, the geometry of the anode substrate 23 and the cathode current collectors 41 and 43, and cathode catalyst carrier 51, when present, the size of the individual substrate and current collector elements, the internal reinforcement of the permionic membrane 11, and the thickness of the permionic membrane 11. It is to be understood that when a cathode catalyst carrier 51 is utilized, the geometry thereof is the same as the geometry of the fine current collector 41, and whenever pressure or geometry parameters of the fine current collector are referred to, it is to be understood that the cathode catalyst carrier is also contemplated, and the same parameters apply with respect thereto.

For any electrode-permionic membrane combination, the determination of a satisfactory pressure, that is, a pressure at which increasing imposed pressures give no significant decrease in voltage, is a matter of routine experimentation.

For unreinforced Asahi Glass Flemion (TM) carboxylic acid membranes, where the anode substrate 23 is of eight to ten strands per inch of 1 millimeter diameter titanium and the fine cathode current collector 41 or cathode catalyst carrier 51 has forty to sixty percent open area and about 200 to 300 openings per square centimeter, and is steel or nickel, compressive pressure between the cathode current collector, and the anode substrate 23 of from at least one pound per square inch, up to about 20 pounds per square inch yield voltage reductions.

The anode substrate 23 and the cathode current collector 41 and cathode catalyst carrier 51 are preferably fine mesh having a high percentage of open area, e.g., above about 40 percent open area to about 60 percent open area, and a narrow pitch, e.g., about 0.5 to 2 millimeters between individual elements thereof. A suitable anode substrate 23, cathode current collector 41 or cathode catalyst carrier 51 is one having about 10 to 30 strands per inch, where the individual stands are from about 0.5 to about 2.5 millimeters apart, center line to center line, and a diameter such as to provide at least 40 percent open area, preferably 60 percent open area, and from about 75 to about 400 openings per square centimeter.

The permionic membrane 11 should be chemically resistant, cation selective, with anodic chlorine evolution catalyst 23 on the anodic surface, bearing upon or bonded to or bonded to and embedded in the anodic surface and cathodic catalyst 33 bonded to the cathodic surface of the permionic membrane 11 or cathodic catalyst carrier 51 compressively bearing thereon.

The fluorocarbon resin permionic membrane 11 used in providing the solid polymer electrolyte 1 is characterized by the presence of cation selective ion exchange groups, the ion exchange capacity of the membrane, and the glass transition temperature of the membrane material.

The fluorocarbon resins herein contemplated have the moieties:

$$\left(CF_2-CXX'\right) \text{ and}$$

$$\left(CF_2-\underset{\underset{Y}{|}}{C}-X\right)$$

where

X is —F, —Cl, —H, or $-CF_3$; X' is —F, —Cl, —H, $-CF_3$ or $CF_3(CF_2)_m$—; m is an integer of 1 to 5; and Y is —A, —$\phi$—A, —P—A, or —O—$(CF_2)_n$ (P, Q, R)—A.

In the unit (P, Q, R), P is $-(CF_2)_a(CXX')_b(CF_2)_c$, Q is $(-CF_2-O-CXX')_d$, R is $(-CXX'-O-CF_2)_e$, and (P, Q, R) contains one or more of P, Q, R, and is a discretionary grouping thereof.

$\phi$ is the phenylene group; n is 0 or 1; a, b, c, d and e are integers from 0 to 6.

The typical groups of Y have the structure with the acid group, A, connected to a carbon atom which is connected to a fluorine atom. These include $(CF_2)$ A, and side chains having ether linkages such as:

$$-O\left(CF_2\right)_xA,\ \left(O-CF_2-\underset{\underset{Z}{|}}{CF}\right)_yA,$$

$$\left(O-CF_2-\underset{\underset{Z}{|}}{CF}\right)_x\left(O-CF_2-CF_2\right)_yA, \text{ and}$$

$$-O-CF_2\left(CF_2-O-\underset{\underset{Z}{|}}{CF}\right)_x\left(CF_2\right)_y\left(CF_2-O-\underset{\underset{R}{|}}{CF}\right)_zA$$

where x, y, and z are respectively 1 to 10; Z and R are respectively —F or a $C_{1-10}$ perfluoroalkyl group, and A is the acid group as defined below.

In the case of copolymers having the olefinic and olefin-acid moieties above described, it is preferable to have 1 to 40 mole percent, and preferably especially 3 to 20 mole percent of the olefin-acid moiety units in order to produce a membrane having an ion-exchange capacity within the desired range.

A is an acid group chosen from the group consisting of

—$SO_3H$
—COOH
—$PO_3H_2$, and
—$PO_2H_2$, or a group which may be converted to one of the aforesaid groups by hydrolysis or by neutralization. Whenever a completed, assembled solid polymer electrolyte installed in an electrolytic cell is referred to as being in the acid form, it is to be understood that the alkali salt form is also contemplated.

In one exemplification A may be either —$SO_3H$ or a functional group which can be converted to —$SO_3H$ by hydrolysis or neutralization, or formed from —$SO_3H$ such as —$SO_3M'$, $(SO_2-NH)$ M'', —$SO_2NH-R_1-NH_2$, or —$SO_2NR_4R_5NR_4R_6$; M' is an alkali metal; M'' is H, $NH_4$, an alkali metal, or an alkaline earth metal; $R_4$ is H, Na or K; $R_5$ is a $C_3$ to $C_6$ alkyl group, $(R_1)_2$ $NR_6$, or $R_1NR_6$ $(R_2)_2$ $NR_6$; $R_6$ is H, Na, K or $—SO_2$; and $R_1$ is a $C_2$–$C_6$ alkyl group.

In a particularly preferred exemplification of this invention, A may be either —COOH, or a functional group which can be converted to —COOH by hydrolysis or neutralization such as —CN, —COF, —COCl, $—COOR_1$, —COOM, $—CONR_2R_3$; $R_1$ is a $C_{1-10}$ alkyl group and $R_2$ and $R_3$ are either hydrogen or $C_1$ to $C_{10}$ alkyl groups, including perfluoralkyl groups, or both. M is hydrogen or an alkali metal; when M is an alkali metal it is most preferably sodium or potassium.

Cation selective permionic membranes where A is either —COOH, or a functional group derivable from or convertible to —COOH, e.g., —CN, —COF, COCl, $—COOR_1$, —COOM, or $—CONR_2R_3$, as described above, are especially preferred because of their voltage advantage over sulfonyl membranes. This voltage advantage is on the order of about 0.1 to 0.4 volt at a current density of 150 to 250 amperes per square foot, a brine content of 150 to 300 grams per liter of sodium chloride, and a caustic soda content of 15 to 50 weight percent sodium hydroxide. Additionally, the carboxylic acid type membranes have a current efficiency advantage over sulfonyl type membranes.

The membrane materials useful in the solid polymer electrolyte herein contemplated have an ion exchange capacity from about 0.5 to about 2.0 milligram equivalents per gram of dry polymer, and preferably from about 0.9 to about 1.8 milligram equivalents per gram of dry polymer, and in a particularly preferred exemplification, from about 1.1 to about 1.7 milligram equivalents per gram of dry polymer. When the ion exchange capacity is less than about 0.5 milligram equivalents per gram of dry polymer, the voltage is high at the high concentrations of alkaline metal hydroxide herein contemplated, while when the ion exchange capacity is greater than about 2.0 milligrams equivalents per gram of dry polymer, the current efficiency of the membrane is too low.

The content of ion exchange groups per gram of absorbed water is from about 8 milligram equivalent per gram of absorbed water to about 30 milligram equivalents per gram of absorbed water and preferably from about 10 milligram equivalents per gram of absorbed water to about 28 milligram equivalents per gram of absorbed water, and in a preferred exemplification, from about 14 milligram equivalents per gram of absorbed water to about 26 milligram equivalents per gram of absorbed water. When the content of ion exchange groups per unit weight of absorbed water is less than about 8 milligram equivalents per gram the voltage is too high, and when it is above about 30 milligram equivalents per gram the current efficiency is too low.

The glass transition temperature is preferably at least about 20° C. below the temperature of the electrolyte. When the electrolyte temperature is between about 95° C. and 110° C., the glass transition temperature of the fluorocarbon resin permionic membrane material is below about 90° C., and in a particularly preferred exemplification, below about 70° C. However, the glass transition temperature should be above about −80° C. in order to provide satisfactory tensile strength of the membrane material. Preferably the glass transition temperature is from about −80° C. to about 70° C., and in a particularly preferred exemplification from about −80° C. to about 50° C.

When the glass transition temperature of the membrane is within about 20° C. of the electrolyte or higher than the temperature of the electrolyte, the resistance of the membrane increases and the permselectivity of the membrane decreases. By glass transition temperature is meant the temperature below which the polymer segments are not energetic enough to either move past one another or with respect to one another by segmental Brownian motion. That is, below the glass transition temperature, the only reversible response of the polymer to stresses is strain, while above the glass transition temperature the response of the polymer to stress is segmental rearrangement to relieve the externally applied stress.

The fluorocarbon resin permionic membrane materials contemplated herein have a water permeability of less than about 100 milliliters per hour per square meter at 60° C. in four normal sodium chloride at a pH of 10 and preferably lower than 10 milliliters per hour per square meter at 60° C. in four normal sodium chloride of the pH of 1. Water permeabilities higher than about 100 milliliters per hour per square meter, measured as described above, may result in an impure alkali metal hydroxide product.

The electrical resistance of the dry membrane should be from about 0.5 to about 10 ohms per square centimeter and preferably from about 0.5 to about 7 ohms per square centimeter.

Preferably the fluorinated-resin permionic membrane has a molecular weight, i.e., a degree of polymerization, sufficient to give a volumetric flow rate of about 100 cubic millimeters per second at a temperature of from about 15° to about 30° C.

The thickness of the permionic membrane 11 should be such as to provide a membrane 11 that is strong enough to withstand pressure transients and manufacturing processes, but thin enough to avoid high electrical resistivity. The membrane is from 10 to 1000 microns thick and, in a preferred exemplification, from about 50 to about 400 microns thick. Additionally, internal reinforcement, or increased thickness, or crosslinking, or even lamination may be utilized whereby to provide a strong membrane.

According to one preferred exemplification of this invention, the solid polymer electrolyte unit 1 consists of a permionic membrane 11 from about 10 to about 1000 microns thick, having an anode element 21 of anode mesh 23 of from 8 to 10 strands of one millimeter diameter ruthenium dioxide-titanium dioxide coated titanium mesh per inch, and the cathode current carrier 41 has from 40 to 60 percent open area and about 200 to about 300 openings per square centimeter. Preferably the cathode current collector 41 is steel or nickel and the cathode current carrier 41 and anode substrate 21 provide compressive pressures of about 1 pound per square inch up to about 20 pounds per square inch. The cathode particles 33 are, in one exemplification, nickel particles having a diameter of about 2 to about 20 microns, extending no more than about 10 percent of the thickness of the permionic membrane, and having a substantially non-porous region 35 within the membrane 11, and a substantially porous region 37 extending out of the membrane by about 1000 Angstroms, whereby to provide a reaction zone of about 1000 Angstroms thick within the catholyte liquor 30 at the three phase interface of the catholyte liquor 30, the cathode electrocatalyst particle 33, especially the active 37 thereof, and the permionic membrane 11.

The solid polymer electrolyte prepared as described above may be used at high current densities, for example, in excess of 200 amperes per square foot, and preferably in excess of 400 amperes per square foot. Thus, according to a particularly preferred exemplification, electrolysis may be carried out at a current density of 800 or even 1200 amperes per square foot, where the current density is defined as the total current passing through the cell divided by the surface area of one side of the permionic membrane 11.

While this invention has been described in terms of specific details and embodiments, the description is not intended to limit the invention, the scope of which is as defined in the claims appended hereto.

What is claimed is:

1. In a solid polymer electrolyte electrolytic cell having an anolyte compartment separated from a catholyte compartment by a solid polymer electrolyte, said solid polymer electrolyte having a permionic membrane, anode means contacting one surface thereof, and cathode means contacting the opposite surface thereof, the improvement wherein the cathode means comprise oriented particles bonded to and embedded in the permionic membrane and having a lower hydrogen evolution overvoltage catalytic area, and a higher hydrogen overvoltage non-catalytic area, the non-catalytic area being a major portion of the particle bonded to and embedded in the permionic membrane, and the catalytic area being a major portion of the particle extending outwardly from the permionic membrane.

2. The solid polymer electrolyte electrolytic cell of claim 1 wherein the oriented particles have a second, high hydrogen evolution overvoltage surface comprising a major portion of the surface area more than 1000 Angstroms from the permionic membrane.

3. The solid polymer electrolyte electrolytic cell of claim 1 wherein the oriented particles comprise an electroconductive, high overvoltage region embedded in the permionic membrane and an electroconductive, porous, low overvoltage region extending outwardly from the permionic membrane.

4. The solid polymer electrolyte electrolytic cell of claim 3 wherein the electroconductive, high overvoltage region is chosen from the group consisting of iron, steel, cobalt, nickel, copper, platinum, iridium, osmium, palladium, rhodium, ruthenium, and graphite.

5. The solid polymer electrolyte electrolytic cell of claim 3 wherein the electroconductive, low overvoltage, porous region is chosen from the group consisting of platinum black, palladium black, and porous nickel.

6. The solid polymer electrolyte electrolytic cell of claim 3 wherein the electroconductive, high overvoltage region embedded in the permionic membrane is chosen from the group consisting of platinum and graphite, and the electroconductive, low overvoltage porous region extending outwardly from the permionic membrane is platinum black.

7. The solid polymer electrolyte elecrolytic cell of claim 3 wherein the lower hydrogen overvoltage catalytic portion of the particles have a lower magnetic susceptibility than the higher hydrogen overvoltage non-catalytic portion.

8. In a method of electrolysis in a solid polymer electrolyte electrolytic cell having an anolyte compartment separated from a catholyte compartment by a solid polymer electrolyte comprising a permionic membrane, anode means in contact with one surface thereof, and cathode means in contact with the opposite surface, which method comprises evolving chlorine at the anode means and decomposing water at the cathode means, the improvement wherein the cathode means comprise oriented particles having a lower hydrogen evolution overvoltage catalytic area, and a higher hydrogen overvoltage non-catalytic area, the non-catalytic area being a major portion of the particle bonded to and embedded in the permionic membrane, and the catalytic area being a major portion of the particle extending outwardly from the permionic membrane.

9. The method of claim 8 comprising carrying out a major portion of the cathode reaction in a region of catholyte within 1000 Angstroms of the permionic membrane.

10. The method of claim 8 wherein the oriented particles have a second, high hydrogen evolution overvoltage surface comprising a major portion of the surface area more than 1000 Angstroms from the permionic membrane.

11. The method of claim 8 wherein the oriented particles comprise an electroconductive, imporous region embedded in the permionic membrane and an electroconductive, porous region extending outwardly from the permionic membrane.

12. The method of claim 11 wherein the electroconductive, imporous region is chosen from the group consisting of iron, steel, cobalt, nickel, copper, platinum, iridium, osmium, palladium, rhodium, ruthenium and graphite.

13. The method of claim 11 wherein the electroconductive, porous region is chosen from the group consisting of platinum black, palladium black, and porous nickel.

14. The method of claim 11 wherein the electroconductive imporous region embedded in the permionic membrane is chosen from the group consisting of platinum and graphite, and the electroconductive, porous region extending outwardly from the permionic membrane is platinum black.

15. In an electrolytic cell having an anolyte compartment separated from a catholyte compartment by a permionic membrane, anode means contacting one surface thereof, and cathode means contacting the opposite surface thereof, the improvement wherein the permionic membrane has a porous gel of permionic membrane material on the cathodic surface thereof, and the cathode means comprise an electrocatalyst coated substrate compressively bearing on the porous gel.

16. In a method of electrolysis in an electrolytic cell having an anolyte compartment separated from a catholyte compartment by a permionic membrane, anode means in contact with one surface thereof, and cathode means in contact with the opposite surface, which method comprises evolving chlorine at the anode means and decomposing water at the cathode means, the improvement wherein the permionic membrane has a porous gel of permionic membrane material on the cathodic surface thereof, and the cathode means comprise an electrocatalyst coated substrate compressively bearing on the porous gel.

* * * * *